US007410177B2

(12) United States Patent
Giffin et al.

(10) Patent No.: US 7,410,177 B2
(45) Date of Patent: Aug. 12, 2008

(54) ROTATABLY ADJUSTABLE SNOWBOARD BINDING

(76) Inventors: Jeffrey J. Giffin, 3015 Washington St., Boulder, CO (US) 80304; Benjamin K. Rushwald, 3450 Ash Ave., Boulder, CO (US) 80305

( * ) Notice: Subject to any disclaimer, the term of this patent is extended or adjusted under 35 U.S.C. 154(b) by 390 days.

(21) Appl. No.: 11/002,558

(22) Filed: Dec. 1, 2004

(65) Prior Publication Data

US 2006/0113736 A1 Jun. 1, 2006

(51) Int. Cl.
*A63C 9/00* (2006.01)

(52) U.S. Cl. ..... 280/14.24; 280/14.22; 280/14.21; 280/11.3

(58) Field of Classification Search ..... 280/14.22–24, 280/11.3, 11.31–34, 607, 610, 611, 613, 280/634

See application file for complete search history.

(56) References Cited

U.S. PATENT DOCUMENTS 5,028,068 A 7/1991 Donovan
5,236,216 A * 8/1993 Ratzek ..... 280/607
5,277,635 A 1/1994 Gillis
5,433,636 A 7/1995 Gillis
5,499,837 A 3/1996 Hale et al.
5,553,883 A * 9/1996 Erb ..... 280/607
5,667,237 A 9/1997 Lauer
5,732,959 A 3/1998 Soejima
5,755,046 A 5/1998 Dodge
5,820,139 A * 10/1998 Grindl ..... 280/14.24
5,890,729 A 4/1999 Bayer et al.
5,941,552 A 8/1999 Beran
5,975,554 A 11/1999 Linton
5,984,324 A * 11/1999 Wariakois ..... 280/14.24
6,290,243 B1 9/2001 Beran
6,523,851 B1 2/2003 Maravetz
2006/0197310 A1 * 9/2006 Fletcher ..... 280/607

* cited by examiner

*Primary Examiner*—Christopher Ellis
*Assistant Examiner*—Vaughn T Coolman
(74) *Attorney, Agent, or Firm*—Sheridan Ross P.C.

(57) ABSTRACT

A snowboard binding includes a base plate which is selectively rotatable about a center plate of the binding. A tensioning means, preferably in the form of a cable, interconnects the center plate to a lever mounted on the base plate. The cable frictionally engages the center plate when the lever is placed in the locked position. The base plate is free to rotate about the center plate when the lever is placed in the unlocked position, resulting in the cable being released from engagement with the center plate.

15 Claims, 7 Drawing Sheets

26
24
21
22
X
18
10
34
14
32
28
35
33
19
34
37
20
16
X
12

21
10

18
19
20
38
30
34
30
33
19
28
30
16
36
34
37
35
32

Fig. 3
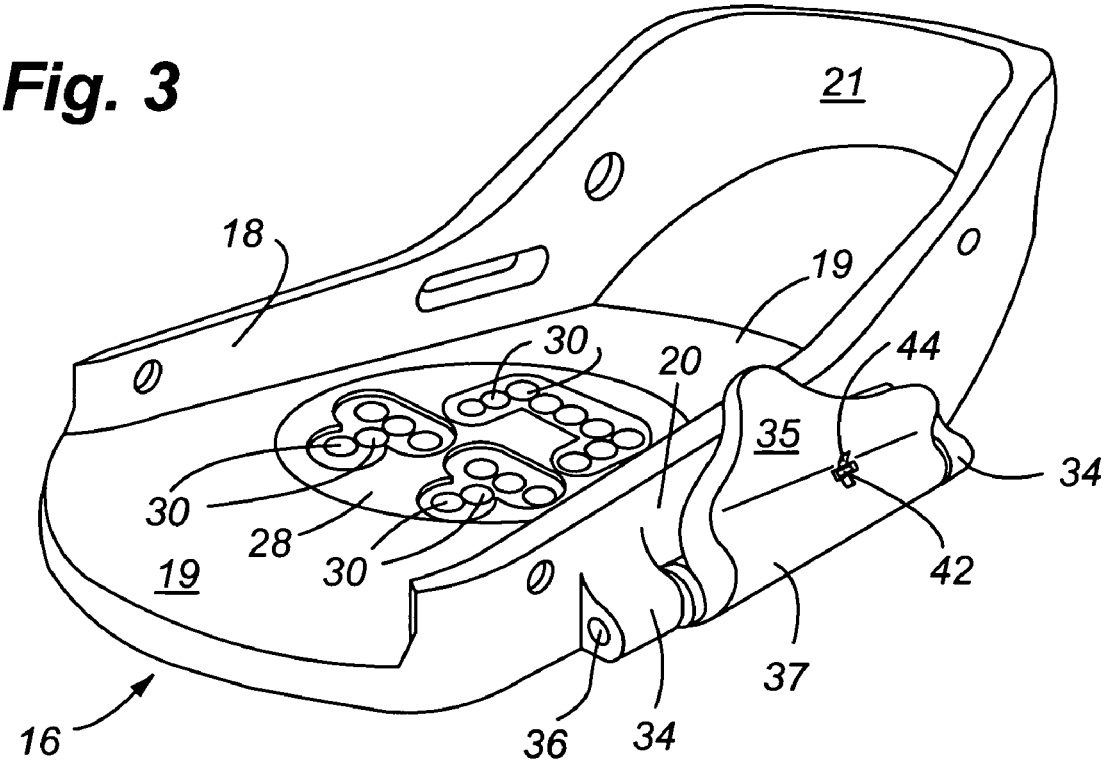
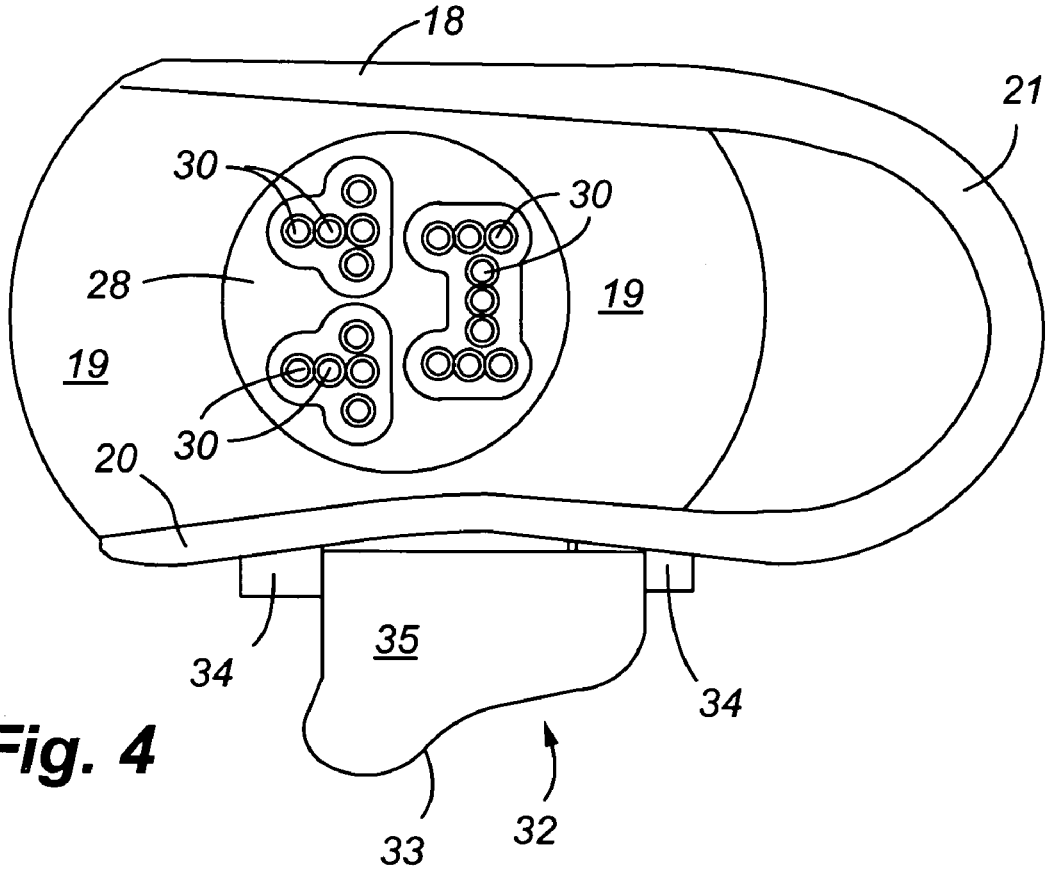
Fig. 4

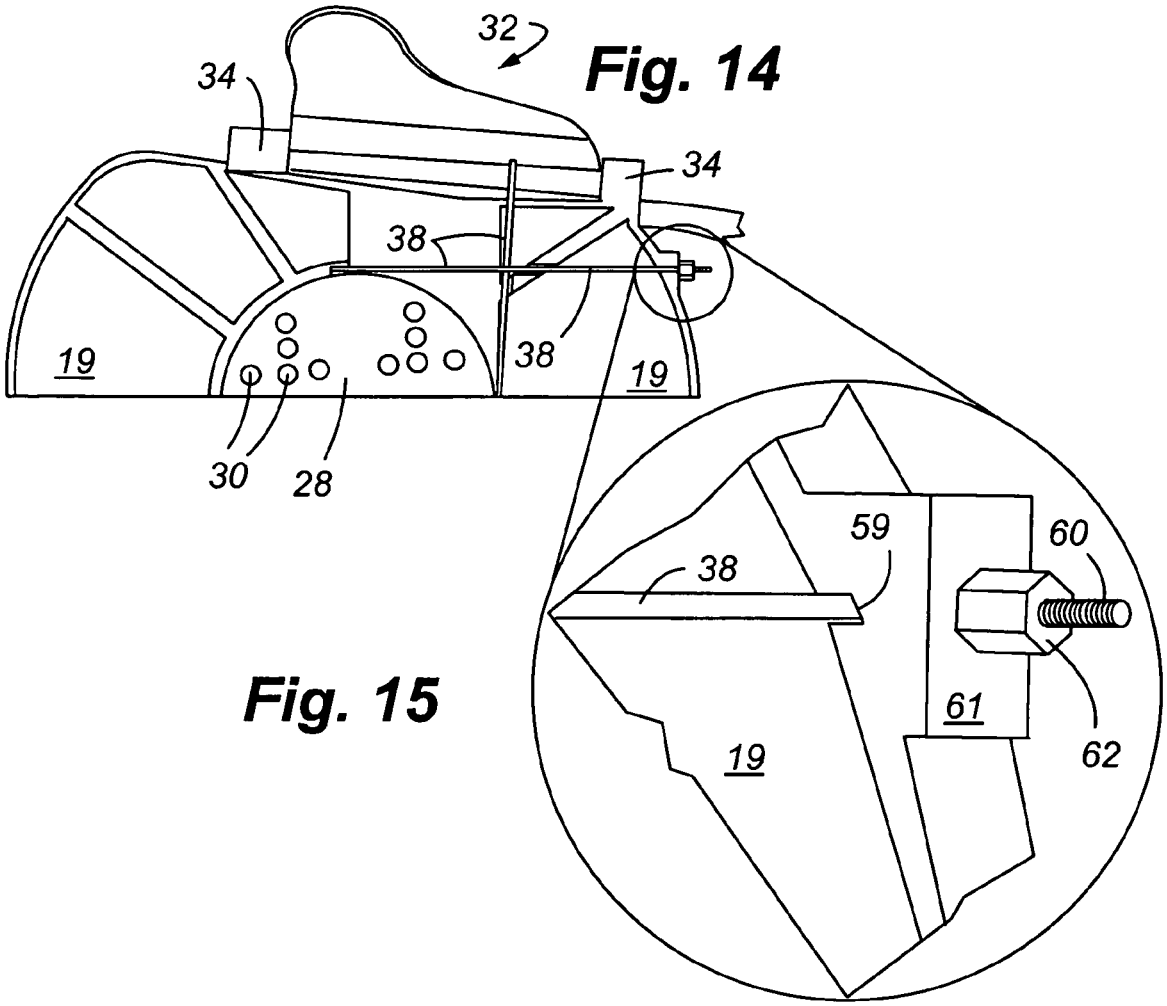
Fig. 14
Fig. 15
Fig. 16
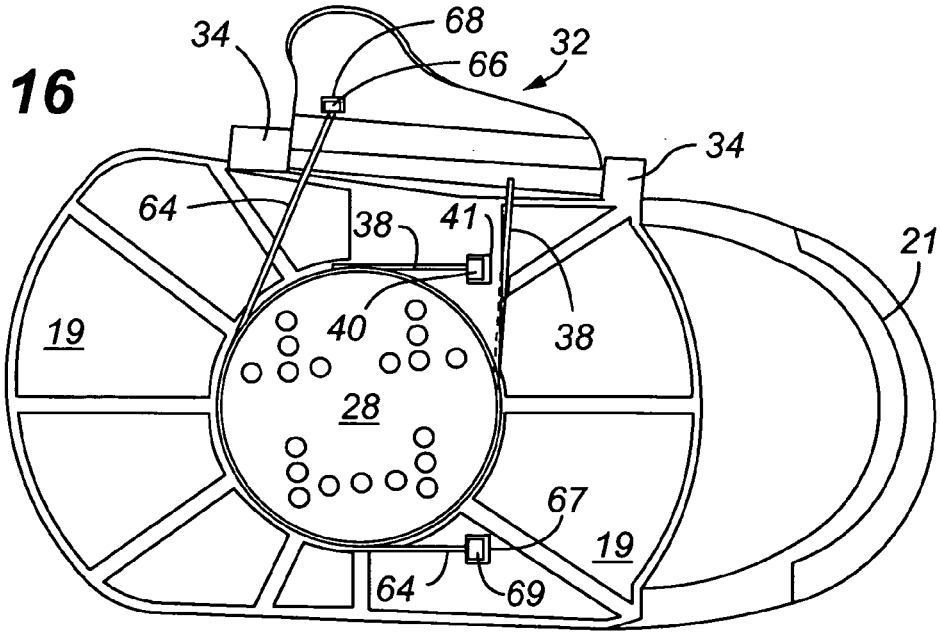

ROTATABLY ADJUSTABLE SNOWBOARD BINDING

FIELD OF THE INVENTION

The present invention relates to a binding especially adapted for securing a snowboard boot to a snowboard, and more particularly, to a rotatably adjustable snowboard binding that allows rotation of the binding with respect to the snowboard while the user's boot may remain attached to the binding.

BACKGROUND OF THE INVENTION

Snowboarding has become a very popular winter sport, and there have been a myriad of developments with respect to snowboard bindings and basic snowboard technology. As snowboarding has become more popular, snowboarders have also devised expanded types of activities that may be conducted while snowboarding. In addition to simply traversing down a slope, most ski/snowboard areas also have snowboard parks that allow snowboarders to conduct various types of snowboard "tricks". For example, a snowboard park may include a "grind rail" and a "half-pipe". In order for a snowboarder to best enjoy both standard snowboarding (traversing down slope) and snowboard parks, a snowboarder must be able to adjust the angle at which the feet are positioned on the snowboard. For traversing down a slope, a snowboarder may wish to have his/her feet positioned at a particular angle with respect to the longitudinal or long axis of the snowboard. When the snowboarder chooses to conduct tricks like at a snowboard park, the snowboarder may wish to place the feet at a more perpendicular angle with respect to the long axis of the snowboard.

Because snowboarders do not use poles like a skier, it is much more difficult for a snowboarder to maneuver over level ground. The most typical way in which a snowboarder moves over level ground is in a "skateboard" fashion. The rear foot is disconnected from the snowboard and is used to push on the ground surface and propel the snowboarder while the front foot remains attached to the snowboard binding. Because the snowboarder's feet are typically mounted at a transverse angle with respect to the long axis of the snowboard, the snowboarders front foot is rotated medially inwards when moving over level ground, which provides great discomfort to the snowboarder, as well as creating a potentially hazardous position for a snowboarder's knee and ankle. It has been documented that prolific snowboarders have increased knee and ankle ailments which can be in part attributed to the medially rotated position of the front foot when traversing over level ground. Unfortunately for the snowboarder, traversing over level ground cannot be avoided because each time the snowboarder uses a ski lift to transport the snowboarder up a mountain, the area around the ski lift is typically flat. Also, further discomfort is experienced by the snowboarder in riding a chairlift because it is difficult to position the snowboard on the foot rest of the chairlift.

A number of references disclose various snowboard bindings to include those which are especially adapted for allowing a snowboarder to rotate the snowboard binding at the desired angle with respect to the long axis of the snowboard. Some examples of these references include the U.S. Pat. Nos. 5,499,837; 5,028,068; 6,290,243; 5,433,636; 5,667,237; 5,890,729; and 5,975,554. While these references may each be adequate for their intended purposes, there are a number of shortcomings with respect to each. One significant shortcoming for some of the references is that they disclose snowboard bindings that are structurally complex, therefore more expensive to manufacture, and are also more prone to malfunction because of the number of moving parts. Another significant shortcoming of the prior art is that any rotational adjustment capability is not provided in a manner that allows the user to quickly and efficiently adjust the rotational position of the binding. For those bindings that are adjustable, many only have a limited number of adjustment positions. Ideally, adjustment of the snowboard binding should be provided in a manner that allows the snowboarder to make adjustments while one's foot remains attached to the binding, and in a manner that allows the snowboarder to use a gloved hand or even use the foot which has been disconnected from the board during traveling over horizontal terrain.

It is well known that snowboard bindings operate in harsh conditions not only in terms of exposure to the elements, but also in terms of stress and strain placed on the binding by the snowboarder. Thus, structurally simple yet reliable bindings are an advantage. Therefore, there is still a need for a snowboard binding which allows quick and efficient adjustment by the snowboarder, yet has a simple and reliable construction which makes the binding economically feasible for manufacture, as well as making the binding easy to maintain in a high state of repair.

SUMMARY OF THE INVENTION

In view of the foregoing disadvantages inherent in the known types of snowboard bindings now present in the prior art, the present invention provides an improved snowboard binding that may be quickly and efficiently rotated by the snowboarder, and the binding incorporates a simple yet reliable structure. To this end, the present invention is characterized by a binding base plate which is secured to the snowboard by a binding center plate which remains attached to the snowboard during use. The binding base plate may be selectively rotated to the desired angular position. The structure used to allow rotation of the base plate includes a lever which is attached to either the medial or lateral upstanding sidewall of the base plate, and a tensioning means which interconnects the center plate to the lever. The tensioning means is preferably a cable or strap which is routed around a periphery of the center plate and having one end that is secured to the base plate, and having an opposite end which is secured to the lever. The lever is movable between a locked and unlocked position. In the unlocked position, the tensioning means is loosened to a degree that allows the snowboarder to rotate the base plate to the desired angle with respect to the longitudinal axis of the snowboard. The snowboarder may then place the lever in the locked position by depressing the lever, thereby causing the tensioning means to frictionally engage the periphery of the center plate, and thus preventing rotation of the base plate.

An inherent safety feature incorporated in the lever of the present invention to prevent the lever from being inadvertedly moved from the locked to the unlocked position is achieved by the particular arrangement of the lever and tensioning means. The tensioning means is tightened and loosened around the center plate by rotational movement of the lever. The greatest amount of force required to rotate the lever from the unlocked to the locked position occurs at an angular point along the arc or rotation of the lever somewhere between the locked and unlocked position of the lever. Thus, some amount of force has to be applied to the lever in order for it to be disengaged from the locked to the unlocked position.

In a first embodiment, the lever is also arranged so that its axis of rotation is substantially parallel to the surface of the snowboard. Accordingly, engaging the lever requires force to be applied in a more vertical direction with respect to the ground. Thus, a snowboarder can use either a gloved/mittened hand or the free foot to operate the lever. If it is desired to be able to operate the lever with the free foot, that is, the foot removed from the binding, then it is preferable to have the lever mounted on the medial side of the base plate.

The tensioning means or cable can be selected from a desired size and material which allows the cable to most effectively frictionally engage the periphery of the center plate. Additionally, the present invention also contemplates the use of more than one tensioning means to increase the amount of frictional resistance between it and the center plate.

A number of other optional features may be provided with the present invention to include yet an additional safety feature in the form of a spring loaded pin which has a normally extended position to block rotation of the lever from the locked to the unlocked position. Depressing the safety pin and then rotating the lever in an upward fashion allows the lever to move to the unlocked position.

The shape of the lever itself is ergonomically designed so that it can be easily manipulated by both a mittened hand and the free booted foot of the snowboarder.

Means may also be provided to adjust the effective length of the cable thereby also providing adjustability for the amount of force necessary to operate the lever. In the preferred embodiment, this further adjustment feature may be achieved by use of a turnbuckle-type arrangement which shortens or lengthens the length of cable extending between the fixed position on the base plate and the attachment point on the lever.

Yet an additional feature that may be provided with the present invention is one or more indexes placed on the upper surface of the snowboard adjacent the binding which provides a visual indication for the snowboarder as to how the binding should be aligned with the snowboard for various snowboarding activities. For example, the indices can be in the form of lines which are placed on the upper surface of the snowboard and which orient a lateral or medial edge of the base plate for the desired type of snowboarding activity such as free ride, walking or free style.

In a second embodiment of the present invention, the concept of providing a tensioning means is used to secure the base plate at a desired orientation with respect to the snowboard axis; however, the tensioning means does not contact the center plate. More specifically, the second embodiment of the present invention provides a slot or gap which communicates with the central opening of the base plate, and the tensioning means is secured to the base plate and extends through the gap. One end of the tensioning means is fixed to one side of the base plate, and the opposite end of the tensioning means has a lever attached thereto and positioned on the opposite side of the base plate. The lever has a cam surface formed thereon. As the lever is operated from an unlocked to a locked position, the cam surface on the lever increases the relative distance between the axis of rotation of the lever and the base plate thereby placing tension on the tensioning means and simultaneously transferring a compression force through the base plate. In response, the base plate compresses and the gap narrows, thus reducing the effective diameter of the central opening. Thus, the interior surface defining the central opening frictionally engages the center plate and prevents rotation of the base plate. Increasing the effective diameter of the central opening by moving the lever to the unlocked position allows a small gap to be created between the center plate and the central opening, and thereby also allowing rotation of the base plate with respect to the center plate.

In accordance with the method of the present invention, one primary feature is the ability to rotate the base plate with respect to the center plate by a force which is directed perpendicular to the ground, as opposed to parallel with the ground. Thus, as mentioned above, the lever is more easily operated by the snowboarder's mittened hand or free booted foot.

Other features and advantages of the present invention will become apparent from a review of the following detailed description taken with the drawings.

BRIEF DESCRIPTION OF THE DRAWINGS

FIG. 3 is another perspective view showing the lever in the unlocked position;

FIG. 4 is an upper plan view of the snowboard binding;

FIG. 14 is a fragmentary lower plan view of the binding illustrating a tensioning adjustment means;

FIG. 15 is an enlarged fragmentary perspective view of the tensioning adjustment means;

FIG. 16 is another lower plan view illustrating another feature in the form of an additional tensioning cable;

DETAILED DESCRIPTION OF THE DRAWINGS

Figure 1:
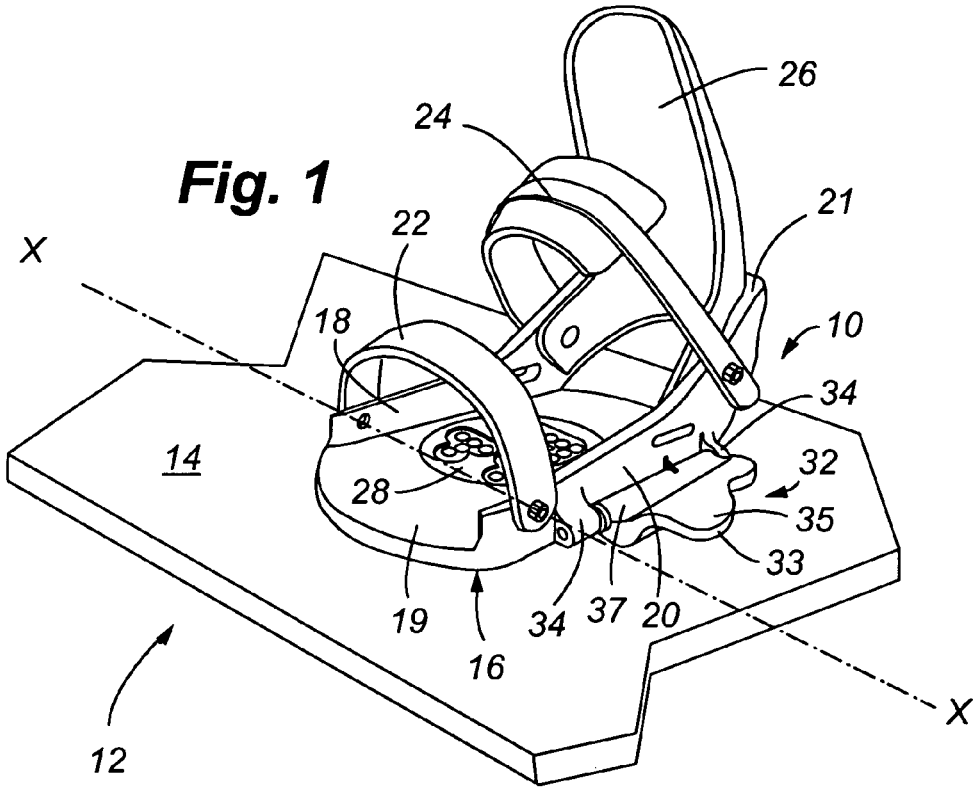
FIG. 1 is a perspective view of a rotatably adjustable snowboard binding of the present invention mounted to a snowboard.

FIG. 1 illustrates the snowboard binding 10 of the present invention mounted to an upper surface 14 of a snowboard 12. The snowboard 12 extends along a long or longitudinal axis x-x. Thus, as shown, the binding 10 is mounted at an angle with respect to the longitudinal axis. The binding has two main components, namely, a base plate 16 and a center plate 28. The base plate includes a lower portion 19 that contacts the upper surface 14 of the snowboard, a lateral sidewall 18, and a medial sidewall 20 which each extend substantially perpendicular to the lower section 19. The rear portion of both the medial and lateral sidewalls connect to a heel wall 21. The binding may also include various straps or other attachment means for attaching a snowboard boot to the binding. More specifically, the binding may include a toe strap 22, an instep strap 24, and an upstanding heel support 26. The description of the binding thus far can be considered exemplary of a conventional snowboard binding, the above-described features being available in a number of commercially available devices.

The description of the features that follow now present the improvements contained within the present invention and which provide the various advantages as discussed above. A handle or lever 32 is attached to a side of the binding, preferably the medial sidewall 20. The handle/lever 32 has an exterior edge 33, and a protrusion or extension 35 that extends the length of the lever away from the binding. The extension 35 is of a size that allows either a mittened hand or snowboard boot to lift or depress the lever. A pair of mounting supports 34 are formed on one of the medial/lateral sides to which the lever is to be mounted. A mounting pin 36 extends through an opening formed in the cylindrical portion 37 of the lever 32 and an opening formed in each of the mounting supports. Thus, the lever 32 rotates around the pin 36 in either an upward or downward fashion. Preferably, pin 36 is actually two separate pin sections, one pin section being received on one side of the opening in cylindrical portion 37, and the other pin being received on the other side thereby leaving a gap for cable 38 to move freely and achieve the locked position. Therefore, reference to the pin 36 shall also be understood as including a pin having two distinct sections.

Figure 2:
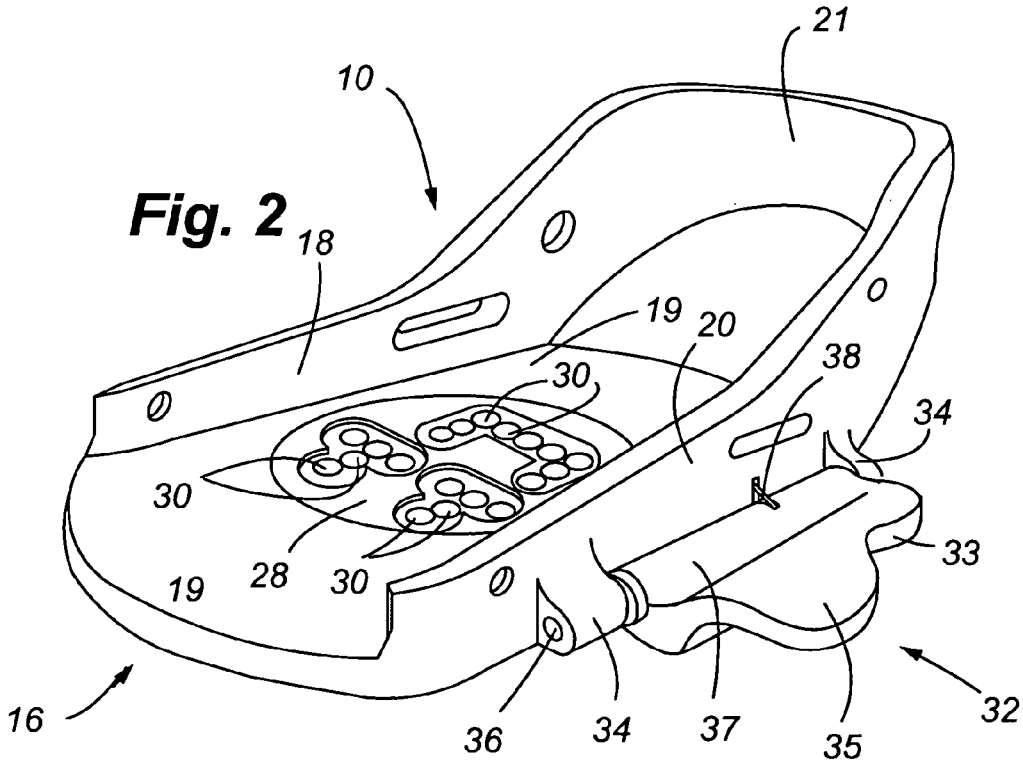
FIG. 2 is an enlarged perspective view of the snowboard binding illustrating the lever in the locked position.

The position of the lever in FIGS. 1 and 2 shows the lever in the locked position, while the position of the lever shown in FIG. 3 illustrates the unlocked position. As also shown, the mounting supports 34 are arranged on a side of the binding so that the pin extends substantially parallel to the upper surface 14 of the snowboard 12.

FIG. 4 is an upper plan view illustrating the binding, and showing the lever in the locked position. FIG. 4 also illustrates a particular hole pattern for the holes 30 that extend through the center plate. Fasteners such as screws (not shown) are inserted through the desired holes 30 to secure the center plate to the snowboard. Any type of hole pattern may be chosen depending upon the locations on the board where the center plate is to be secured.

Figure 5:
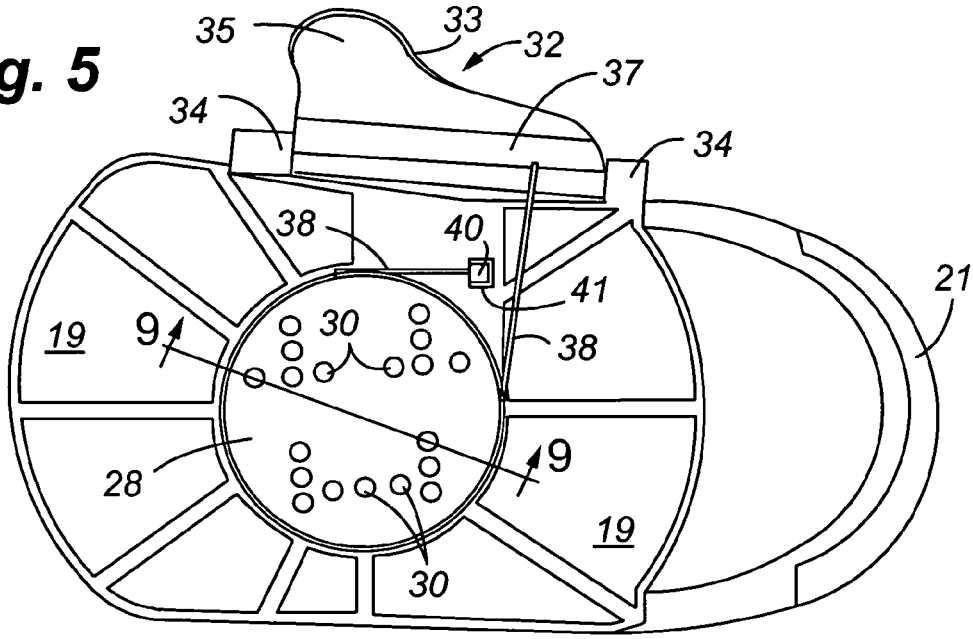
FIG. 5 is a lower perspective view of the snowboard binding specifically illustrating the arrangement of the cable as it is routed around the periphery of the center plate and secured to the lever and the base plate.
Figure 8:
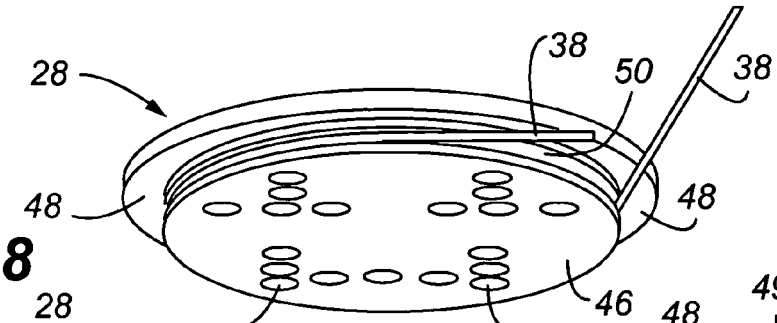
FIG. 8 is an exploded and greatly enlarged perspective view of the center plate and the portion of the cable extending around the periphery of the center plate.

FIG. 5 illustrates further details of the invention to include the tensioning means 38, shown in FIG. 5 as a cable, strap, band, or other flexible member that resists any appreciable stretching. The cable 38 has a first end that is secured to the lower surface of the lower section 19. One way in which this end can be secured is to provide an anchor 40 attached to the end of the cable, and then placing the anchor 40 within a recess or slot 41 that is formed on the lower surface 19. Now also referring to FIG. 8, the cable extends from the anchor 40 around the periphery of the center plate. The cable 38 then extends away from the periphery of the center plate to the lever 32. Referring to FIG. 3, the end of the cable extending toward the lever 32 is secured to the lever 32 by use of another anchor or stop 42 attached to the end of the cable. The cable at this location extends through an opening 44 in the lever 32, and the stop/anchor 42 is larger than the opening 44 thereby preventing the cable from being pulled back through the opening 44. The stop/anchor 42 can be set within a small channel formed in the outer surface of the lever 32 so the lever does not protrude from the lever.

Figure 6:
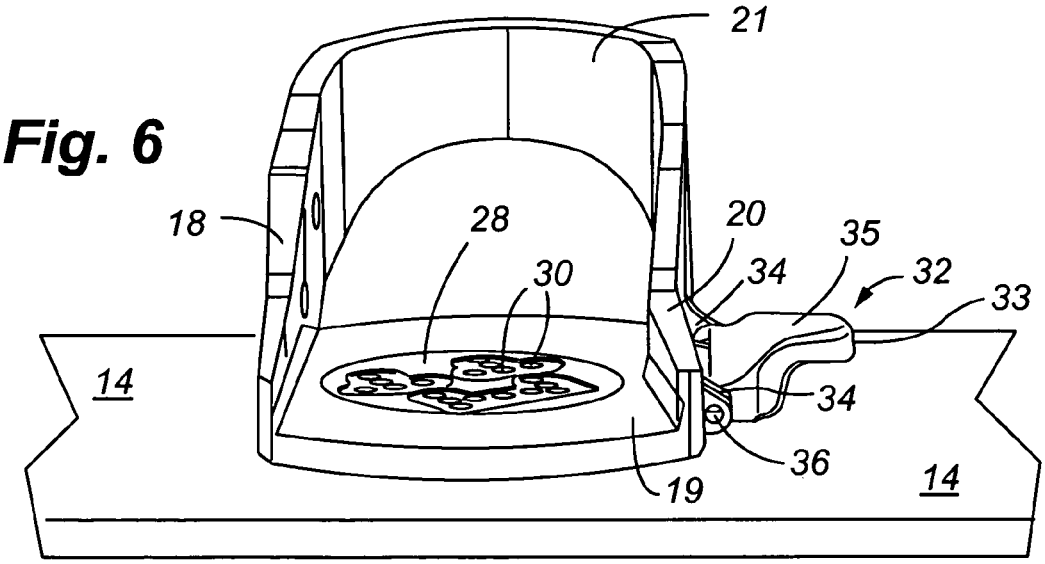
FIG. 6 is another perspective view of the snowboard binding showing the lever in the locked position.
Figure 7:
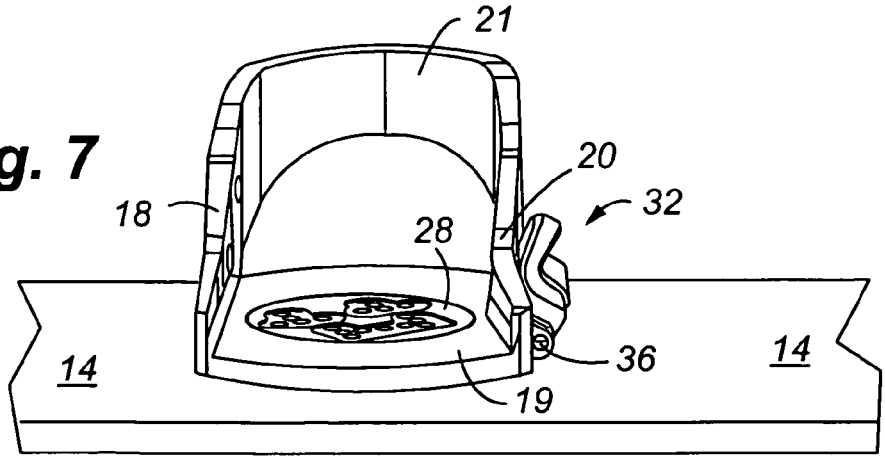
FIG. 7 is another perspective view of the snowboard binding showing the lever in the unlocked position.

In operation, a snowboarder would move the lever to the unlocked position, and then rotate the binding 16 to the desired angular rotation with respect to the longitudinal axis of the snowboard. After rotation of the binding, the user simply pushes down on the lever thus placing the binding in the locked position. In the unlocked position, the cable is loosened since upward rotation of the handle causes the handle to move toward the center plate. When the lever is moved to the locked position, the cable is pulled tight since the handle forces the end of the cable away from the center plate. FIGS. 6 and 7 best illustrate the movement of the end of the cable attached to the lever as the end of the cable moves with the lever between the locked and unlocked positions.

Figure 9:
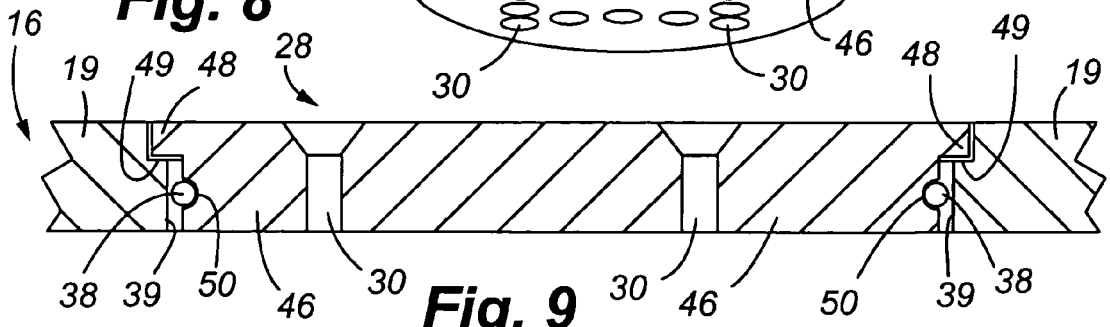
FIG. 9 is a vertical section taken through the center plate illustrating the arrangement of the center plate, base plate, and cable.

Referring to FIG. 9, the manner in which the cable 38 extends around the periphery of the center plate is shown. The center plate 28 has an upper portion 48, and a lower extension 46 having a smaller diameter than the upper portion. A circumferential groove or slot 50 is formed on the periphery of the lower extension 46. The cable 36 fits within this groove 50. The groove 50 is preferably arcuate shaped that allows the cable 38 to be effectively captured therein, but also allows the cable 38 to be loosened such that the cable does not become bound up within the groove when loosened by movement of the lever to the unlocked position. As also shown, the upper portion 48 resides on a circumferential ledge 49 that is formed in the central opening of the base plate 16. The inner surface 39 defining the central opening of the binding plate is slightly larger than the diameter of the lower extension 46 thereby providing some definable gap between the cable 38 and the inner surface 39.

Figure 10:
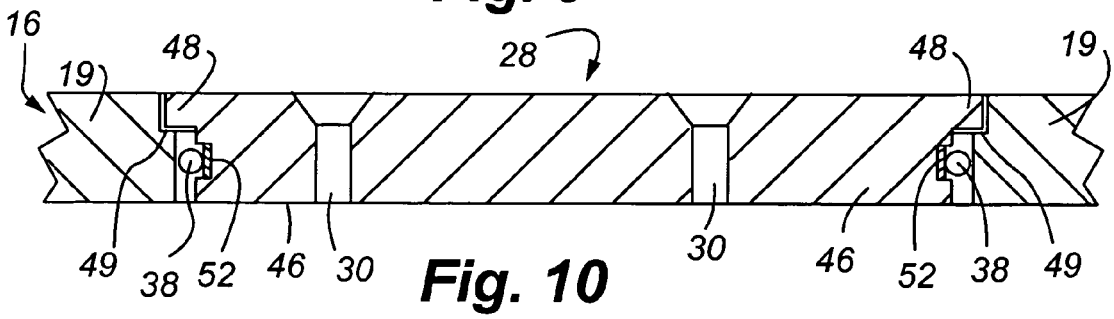
FIG. 10 is another vertical cross-section illustrating a friction-enhancing layer that may be placed on the periphery of the center plate.

As shown in FIG. 10, one optional feature which may be incorporated within the present invention is the use of a friction enhancing layer 52 that is applied over the groove 50, thereby providing additional frictional resistance between the cable 38 and the groove when the lever is placed in the locked position. For example, this frictional enhancing layer 52 could be a strip of neoprene which is permanently affixed to the groove 50. Neoprene is also an advantageous material because the cable 38 would not adhere to the neoprene layer, thereby ensuring the cable could be loosened without binding.

Figure 11:
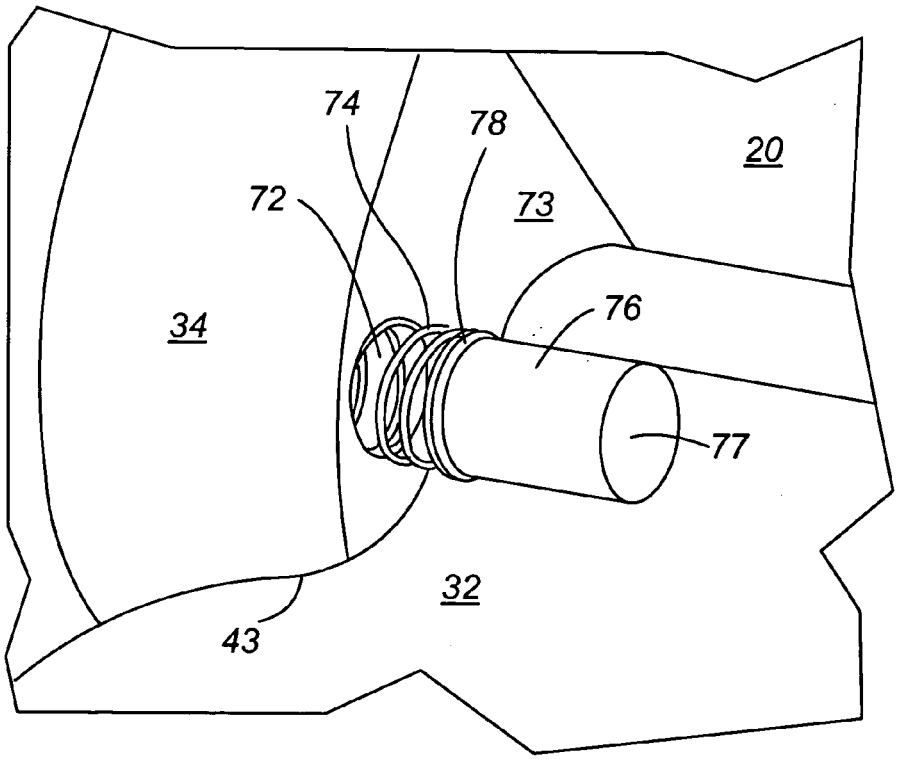
FIG. 11 is an enlarged exploded fragmentary perspective view of a safety pin assembly.
Figure 12:
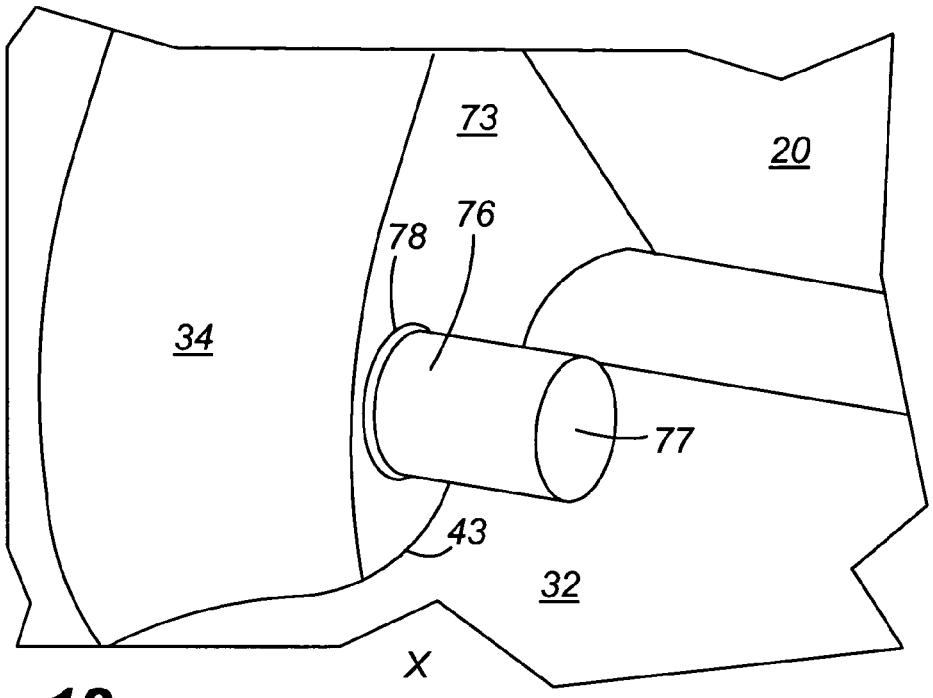
FIG. 12 is another enlarged fragmentary perspective view of the binding showing the safety pin assembly when installed.

FIGS. 11 and 12 illustrate another optional feature of the present invention in the form of a safety pin 76 that may also be mounted to one of the mounting supports 34. Referring first to FIG. 11, the safety pin 76 is mounted within an opening 72 formed in one of the mounting supports 34. A biasing means such as a spring 74 is placed between one end of the pin 76 and the bottom of the opening 72. The pin 76 may include a slight flange or enlarged portion 78 formed on one end of the pin. The opening 72 could have a slightly smaller diameter at the interface with surface 73, by incorporating a small tab or the like (not shown) and thereby allowing free travel of the pin 76 in the opening 72 but preventing removal by flange 78 striking the tab. Pin 76 would normally extend to the position shown in FIG. 12 when the lever 32 was rotated downwards in the locked position. Accordingly, the pin 76 in the normally extended position prevents inadvertent upwards rotation of the lever to the unlocked position. In order to rotate the lever 32 to the unlocked position, a user would simply depress the pin 76 thereby allowing the edge 43 of the lever 32 to clear the end 77 of the pin.

Figure 13:
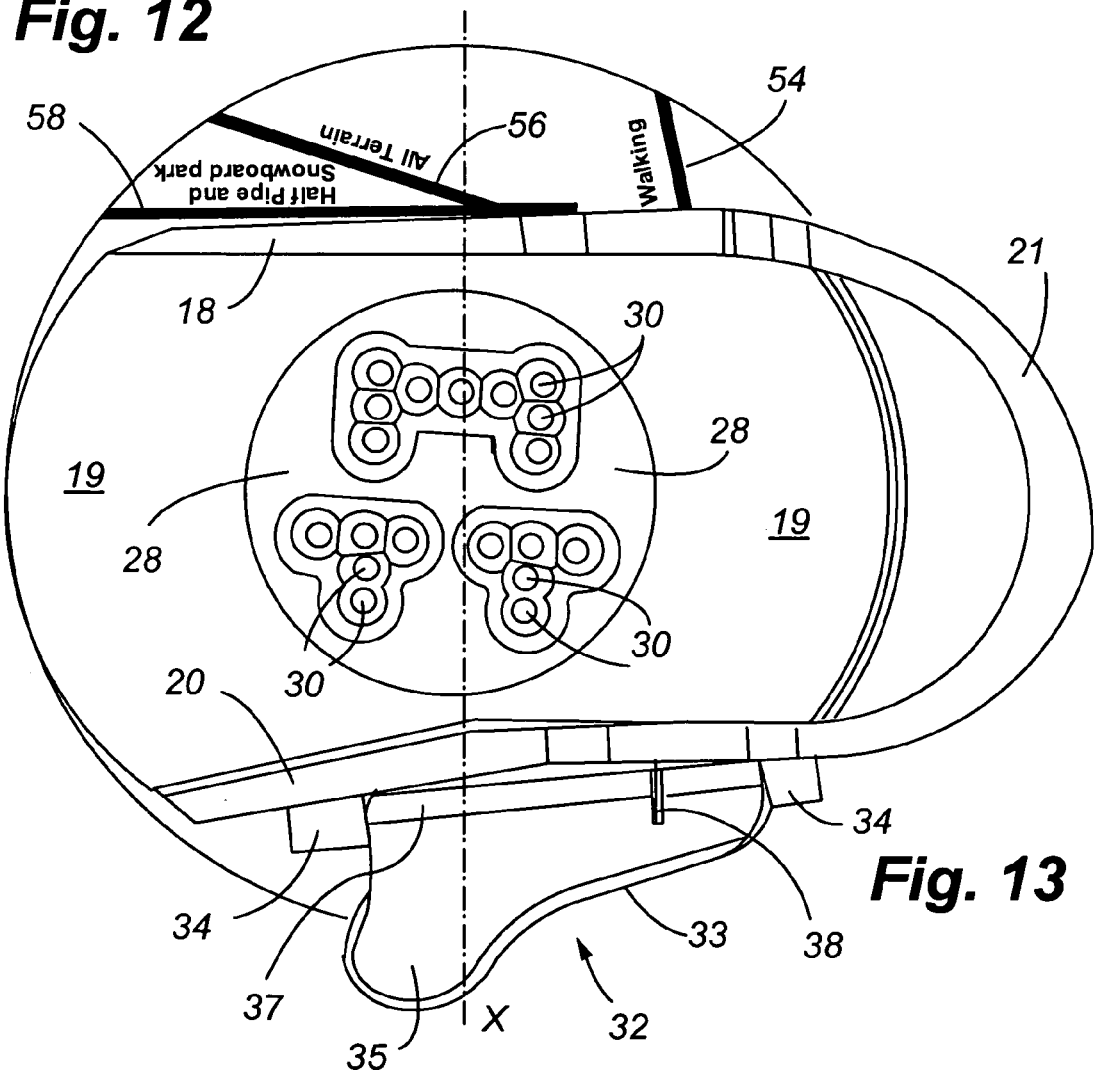
FIG. 13 is a fragmentary upper plan view of the binding illustrating various indices that may be placed on the upper surface of the snowboard allowing alignment of the binding for desired snowboard activities.

FIG. 13 illustrates yet another feature of the present invention in the form of indices that may be placed on the upper surface of the snowboard. The indices shown are three lines 54, 56, and 58 which provide a visual indication for the snowboarder as to how to orient the binding to best correspond to a specific snowboard activity. The index 54 represents a preferred orientation of the binding if the snowboarder wishes to walk, for example, to move along relatively flat ground such as when the snowboarder enters a lift line. Index 56 represents a preferred orientation of the binding for all terrain activity, such as snowboarding down the slope of a mountain. Index 58 represents a preferred orientation of the snowboard best suited for conducting snowboarding within a half-pipe or snowboard park. The binding in FIG. 13 has been oriented along index 58 whereby the lateral side 18 is substantially parallel with the line 58. The indices may be provided by an adhesive backed pad that is secured to the upper surface of the snowboard. This pad also provides some scratch protection to the snowboard for the area covered by the pad. A snowboarder could create their own individual index lines to best suit their personal preferences as to orientation of the binding.

FIGS. 14 and 15 illustrate yet another feature of the present invention which includes a tension adjustment means for making fine adjustments as to the length of the cable 38. Instead of the cable 38 terminating at the anchor 40 located within the recess 41 formed on the lower surface of the lower section 19, the cable 38 extends toward the edge of the lower section 19 and through an opening 59 formed through a portion 61 of the lower section edge. The end 60 of the cable 38 is threaded, and a nut 62 is threaded over the threaded end 60. When it is desired to make fine adjustments to the cable 38 to either tighten or loosen the cable, the nut 62 is rotated either in a tightening or a loosening direction, thereby shortening or lengthening or the length of cable extending between the nut 62 and the lever 32. Thus, the arrangement shown in FIG. 14 provides a turnbuckle-style tension adjustment for the cable 38. It may be necessary to make fine adjustments to the length of the cable 38 to accommodate a particular user's preference as to the amount of force necessary to actuate the lever 32, or to compensate for slight changes in the binding itself or in the length of the cable 32 as they may slightly expand or contract based upon material fatigue or based upon changes in environmental temperature.

Referring to FIG. 16, yet another feature of the present invention incorporates the use of an additional cable 64 thus providing additional capability for increasing the amount of force necessary for locking and unlocking the lever, and thereby also providing additional frictional resistance for maintaining the binding in a desired angular orientation. As shown, the cable 64 has one end that is attached to the lever 32 at a location spaced from the first cable 38. The same arrangement for cable 64 may be used for attaching it to the lever 32, namely, providing an opening 68 through the lever 32, and an anchor/stop 66 that is attached to the end of the cable. The cable 64 then wraps around the periphery of the center plate in a direction opposite to the first cable 38. The other end of the cable 64 then terminates at anchor 69 which is held within another recess or opening 67 formed on the lower surface of the lower section 19.

Figure 17:
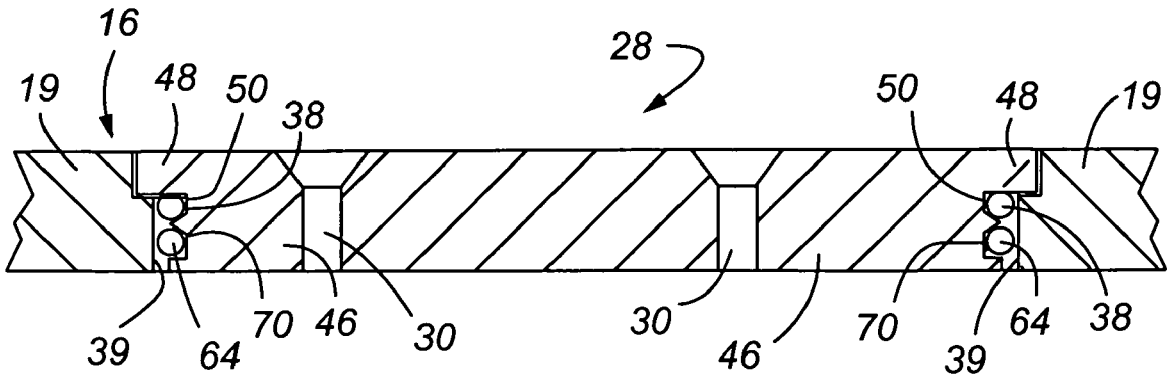
FIG. 17 is a vertical section of the center plate when incorporating a second tensioning cable as shown in FIG. 16.

Referring to FIG. 17, the center plate 28 is modified to include an additional circumferential groove 70 that receives the second cable 64. As shown, circumferential groove 70 is spaced from and disposed below groove 50. Thus, the cable 38 and 64 do not overlap, and are collectively able to increase the surface area contact with the periphery of the center plate to ensure the base plate is locked in the desired orientation.

Figure 18:
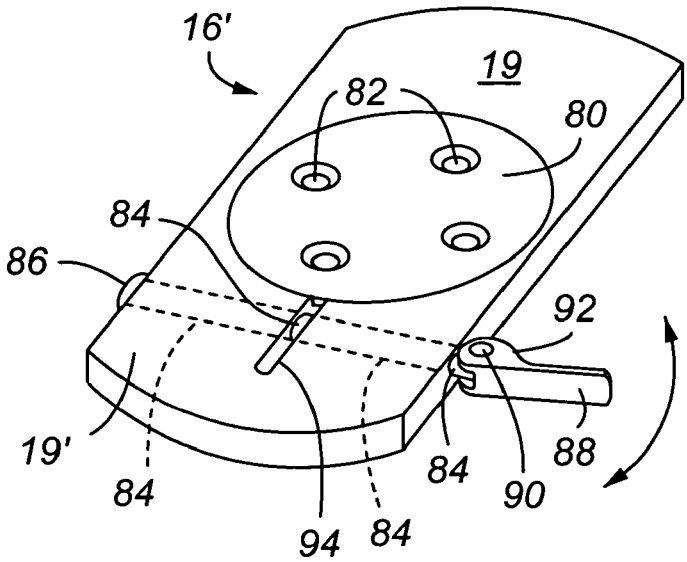
FIG. 18 is a perspective view of a second embodiment of the present invention.

Referring to FIG. 18, a second embodiment of the present invention is shown. The second embodiment includes two main components similar to the first embodiment, namely, a modified base plate 16' and a center plate 80. In order to simplify the figure, FIG. 18 only illustrates the lower section 19' of the modified base plate 16'; however, it shall be understood that the modified base plate 16' also includes a pair of sidewalls, a heel wall, as well as means to secure a snowboarder's boot to the binding such as a toe strap, instep strap, and heel support. The center plate 80 includes a plurality of screw holes 82 for receiving fasteners (not shown) and the center plate is then attached to the snowboard. The modified base plate 16' is rotatable about the fixed center plate 80. Rotation of the modified base plate around the fixed center plate is provided by a tensioning means 84 which extends through a bore or opening formed through the thickness of the base plate 16', the bore/opening extending transversely across the binding. The first end 86 of the tensioning means 84 is secured on one lateral side of the base plate, and the second end of the tensioning means 84 terminates at the other lateral side of the base plate. A pin 90 extends through an opening formed in the second end of the tensioning means as shown. A lever 88 is then secured to the pin 90, and the lever 88 is rotatable in the directions as shown in the figure. The lever 88 has a cam portion 92 which abuts the lateral edge of the base plate.

A slot 94 is formed in the lower section 19, the slot 94 having one end that communicates with the central opening of the base plate. As shown, the tensioning means 84 extends transversely through the slot 94.

In operation, if the snowboarder desires to rotate the base plate with respect to the center plate, the snowboarder rotates the handle/lever 88 to the unlocked position where the lever extends substantially perpendicular to the lateral edge of the base plate as shown in the figure. At this position of the lever, no compression force is applied to the binding, and the base plate may freely rotate about the center plate. Once the desired angular orientation has been selected, the user then places the lever 88 in the locked position by rotating it towards the abutting lateral edge of the base plate. As the lever is rotated, the cam portion 92 engages the lateral edge, and depending upon the size of the cam surface, the second end of the tensioning means 84 is drawn away from the lateral edge. As the end of the tensioning means is drawn away, a compression force is transmitted by the cam in a direction through the width of the binding. This compression force narrows the width of the slot 94, thereby reducing the effective diameter of the central opening of the binding. Thus, the interior surface defining the central opening tightly engages the periphery of the center plate, thus preventing rotation of the base plate with respect to the center plate. As with the first embodiment, it is desirable to have the lever operate such that the greatest amount of force applied occurs at some point between the locked and unlocked positions, thereby providing a safety feature so that the lever does not inadvertently become unlocked. With the second embodiment, it is also contemplated that the effective length of the tensioning means 84 can be adjusted by providing a turnbuckle arrangement at the end 86. Therefore, the end 86 could be threaded, and a nut (not shown) could be screwed over the threaded end. The nut could then be adjusted to adjust the effective length of the tensioning means 84.

The advantages of the present invention are clear. The binding provides for a simple yet reliable means to allow a snowboarder to quickly and easily adjust the angular orientation of the binding. In the first embodiment, the rotation of the lever about a horizontally extending axis better suits ones ability to actuate the lever with the free foot or a mittened hand. Use of a tensioning means such as a flexible cable is a structurally simple, yet reliable way to transfer the tension of the cable to the center plate in order to provide frictional resistance.

Although the present invention has been illustrated with respect to preferred embodiments, it shall be understood that various other changes and modifications may be made to the invention which fall within the scope of the claims appended hereto.

We claim:

1. A snowboard binding comprising:

a base plate having a pair of sidewalls integral with said base plate and extending along medial and lateral sides of the base plate, and a central opening formed through said base plate;

a substantially circular center locking plate positioned in said central opening of said base plate, said center plate securing said binding to a snowboard;

a rotatable lever mounted to said medial side and on one of said pair of sidewalls, said lever being movable between a locked position and an unlocked position;

a cable having a first end connected to said lever, and a second end connected to said base plate and extending around a periphery of said center plate, said cable being tightened against said center plate when said lever is rotated to said locked position to prevent rotation of the base plate, and said cable being loosened with respect to said center plate when said lever is moved to the unlocked position thereby enabling the base plate to be rotated about said center plate and placed in a desired angular orientation with respect to the snowboard;

said lever having an axis of rotation extending substantially parallel to an upper surface of the snowboard wherein rotation of said lever in an upwards direction moves the lever to the unlocked position, and movement of said lever in a downward direction moves said lever toward the locked position wherein a greatest amount of force required to rotate the lever from the unlocked to the locked position occurs at an angular point between the locked and unlocked positions, and further wherein the cable rotates with the lever such that the cable moves from a first plane above the upper surface of the snowboard in the unlocked position to a second different plane between the first plane and the upper surface of the snowboard in the locked position; and said binding further includes (i) a pair of mounting supports spaced from one another and mounted to said sidewall on said medial side, (ii) an opening formed in said lever defining said axis of rotation, and (iii) a pin extending through said opening in said lever to secure said lever between said mounting supports, said lever being rotatable about said pin between the locked and unlocked positions.

2. A binding, as claimed in claim 1, wherein: said cable is secured at said second end to a lower surface of said base plate.

3. A binding, as claimed in claim 1, wherein:

said cable extends at least 180° around the periphery of said center plate and in contact therewith thereby providing adequate frictional resistance to maintain said lever in said locked position.

4. A binding, as claimed in claim 1, wherein:

said center plate has upper and lower surfaces substantially parallel to one another, and a thickness substantially equal to a thickness of the snowboard, said center disk further including an upper portion having a first larger diameter, and a lower portion having a second smaller diameter, said lower portion having an outer peripheral surface defining said periphery of said center plate and a groove formed therearound, said cable being routed around said periphery and in said groove.

5. A binding, as claimed in claim 1, wherein:

said cable further includes an adjustable tensioning means for selectively adjusting a tension of said cable thereby providing adjustability for an amount of force required to place said lever in said locked and said unlocked positions, and providing adjustability for an amount of force required to prevent said binding from rotating when said lever is in the locked position.

6. A binding, as claimed in claim 1, further including:

a biased safety pin attached to said binding assembly, said pin extending over a portion of said lever to prevent said lever from being rotated upward to said unlocked position, and said pin being retractable to uncover said lever enabling said lever to be rotated downward to the unlocked position.

7. A binding, as claimed in claim 1, wherein:

said center plate has an outer peripheral surface and a groove formed thereon for receiving said cable.

8. A binding, as claimed in claim 7, wherein:

said groove formed in said center plate has a frictional layer formed thereon for increasing frictional resistance between said cable and said outer peripheral surface of said center plate.

9. A binding as claimed in claim 1, further including:

at least one index placed on an upper surface of said snowboard and indicating an orientation of said binding with respect to said snowboard.

10. A binding as claimed in claim 9, wherein:

said index includes a line placed on the upper surface of the snowboard and extending in a prescribed direction and extending parallel with one side of the binding plate when the binding is rotated in alignment with the line.

11. A snowboard binding comprising:

a base plate having a pair of sidewalls integral with said base plate and extending along medial and lateral sides of the base plate, and a central opening formed through said base plate;

a locking plate positioned in said central opening of said base plate, said center plate securing said binding to a snowboard;

a rotatable lever mounted to said medial side of said pair of sidewalls, said lever being moveable between a locked position and an unlocked position;

a cable having a first end connected to said lever, and a second end connected to said base plate and extending around a periphery of said center plate, said cable being tightened against said center plate when said lever is rotated to said locked position, and said cable being loosened with respect to said center plate when said lever is moved to the unlocked position thereby enabling the base plate to be rotated about the center plate, wherein rotation of said lever in an upward direction moves said lever to the unlocked position, and movement of said lever in a downward direction moves said lever towards the locked position, wherein said cable is attached to said lever between an axis of rotation of said lever and an exterior edge of said lever, and wherein a greatest amount of force required to rotate the lever from the unlocked to the locked position occurs at an angular point between the locked and unlocked positions, and wherein the cable rotates with the lever such that the cable moves from a first plane above an upper surface of the snowboard in the unlocked position to a second different plane between the first plane and the upper surface of the snowboard in the locked position.

12. A snowboard binding assembly comprising:

a base plate having a pair of sidewalls integral with said base plate and extending along medial and lateral sides of the base plate, and a central opening formed through said base plate;

a substantially circular center locking plate positioned in said central opening of said base plate, said center plate securing said binding to a snowboard;

a rotatable lever mounted to one of said medial and lateral sides of said binding, said lever being movable between a locked position and an unlocked position;

a first cable having a first end connected to said lever, and a second end connected to said base plate and extending around a periphery of said center plate, said first cable being tightened against said center plate when said lever is rotated to said locked position to prevent rotation of the base plate, and said first cable being loosened with respect to said center plate when said lever is moved to the unlocked position thereby enabling the base plate to be rotated about said center plate and placed in a desired angular orientation with respect to the snowboard;

said lever having an axis of rotation extending substantially parallel to an upper surface of the snowboard wherein rotation of said lever in an upwards direction moves the lever to the unlocked position, and movement of said lever in a downward direction moves said lever toward the locked position;

a second cable interconnecting said center plate to said lever, said second cable being routed around the periphery of said center plate in a direction opposite of the first cable, said second cable being tightened against said center plate when said lever is rotated to said locked position, and said second cable being loosened with respect to said center plate when said leveler is moved to the unlocked position thereby enabling the base plate to be rotated about said center plate and placed in a desired angular orientation with respect to the ; and wherein first and second cables each have an end connected to said base plate at different locations thereon.

13. A method of positioning a snowboard binding at a desired angular orientation with respect to a long axis of a snowboard, said method including the steps of:

providing a binding including a base plate, and a center plate placed through a central opening in the base plate, said center plate securing said base plate to the snowboard;

providing a cable having a first end secured to the base plate and a second end secured to a rotatable lever mounted to the base plate, said cable being routed to contact a periphery of said center plate, said rotatable lever being positioned so that it rotates about an axis extending substantially parallel to an upper surface of the snowboard;

rotating the lever to an unlocked position;

rotating the base plate around said center plate while said center plate remains stationary with respect to the snowboard thereby changing the length of the cable in contact with the outer periphery surface of the center plate; and rotating the lever to a locked position to tighten the cable in contact against the center plate and thereby preventing rotation of the base plate wherein the cable is loosened in the unlocked position, the cable is tightened in the locked position, and the cable being most tightened at a point when the cable is rotated between the locked and unlocked position thereby providing a counter force to prevent inadvertent rotation of the lever from the locked position to the unlocked position, and wherein the cable rotates with the lever such that the cable moves from a first plane above the upper surface of the snowboard in the unlocked position to a second different plane between the first plane and the upper surface of the snowboard in the locked position.

14. A method, as claimed in claim 13, further including the step of:

depressing a biased safety pin prior to said first rotating step thereby enabling the lever to be rotated to the unlocked position, wherein the biased safety pin automatically extends after said third rotating step thereby preventing the lever from inadvertently rotating from the locked position to the unlocked position.

15. A method, as claimed in claim 13, further including the step of:

aligning the binding with one of several indices marked on the snowboard corresponding to particular angular orientations of the binding with respect to the snowboard.

* * * * *